United States Patent [19]

Miskell

[11] 4,400,153

[45] Aug. 23, 1983

[54] INDIRECTLY HEATED ROTARY CALCINER HAVING WEIGHTED CYLINDRICAL EXTENSIONS

[76] Inventor: Ford F. Miskell, 50 N. Strawberry La., Chagrin Falls, Ohio 44022

[21] Appl. No.: 323,818

[22] Filed: Nov. 23, 1981

[51] Int. Cl.[3] ..... F27B 7/00; F27B 6/08

[52] U.S. Cl. ..... 432/103; 432/112

[58] Field of Search ..... 432/103, 112

[56] References Cited

U.S. PATENT DOCUMENTS

| | | | |
|---|---|---|---|
| 1,503,186 | 7/1924 | Fasting | 432/103 |
| 1,584,381 | 5/1926 | Krebs | 432/112 |
| 2,098,999 | 11/1937 | Brown | 432/103 |
| 4,191,530 | 3/1980 | Bearce | 432/112 |

*Primary Examiner*—John J. Camby

*Attorney, Agent, or Firm*—Fay & Sharpe

[57] ABSTRACT

An indirectly heated rotary calciner or dryer for high temperature operation, whereby it is important to reduce cylinder stress to achieve a reasonable life expectancy of the heated section of a cylinder even when the most exotic of metal alloys is used for its construction.

The present invention is able to reduce the stress in the heated section of an indirectly heated rotary calciner or dryer cylinder by the use of either long extensions beyond the cylinder's riding ring supports or by shorter, weighted extensions beyond said riding ring supports, which act as moment arms and thus permit a calciner to be operated at substantially higher temperatures than would be the case had the invention not been employed, while still achieving good life expectancy.

4 Claims, 5 Drawing Figures

INDIRECTLY HEATED ROTARY CALCINER HAVING WEIGHTED CYLINDRICAL EXTENSIONS

BACKGROUND OF THE INVENTION

In the field of rotary heat processing equipment it is important to make a distinction between *directly* heated equipment, such as directly heated rotary kilns and dryers, and *indirectly* heated rotary calciners, dryers, and other indirectly heated configurations.

Directly heated kilns and dryers employ rotary cylinders in which a hot gas stream (which gives up heat) and a stream of solid particles (which receives heat) are simultaneously passed through the center of the cylinder which may or may not be refractory lined. The hot gas and the cold solid material come into direct contact, and heat is transferred from the hot gas to the cold material largely by the heat transfer processes known as convection heat transfer and by radiation heat transfer. Directly heated cylinders are normally supported in two riding rings which are located approximately one-fifth of the over-all cylinder length in from each end. This configuration minimizes fiber stresses in the cylinder.

An *indirectly* heated rotary calciner is a common item of chemical process equipment having wide usage in the heat treatment of tonnage quantities of a variety of materials.

In the design of all prior indirectly heated rotary calciners, life expectancy of the heated section of the rotating cylinder has been a problem due to excessive stress in the heated section of the cylinder.

Indirectly heated rotary calciners, in general, are characterized as consisting of a rotating cylinder with a center section and minimum extensions on each end thereof, and a furnace surrounding said center section which provides heat. The furnace surrounds the center section which is unsupported. Outwardly of this center section are riding rings and trunnion rolls for support of said riding rings. Driving means, such as a girt gear and spur pinion, rotate the cylinder. Stationary end breechings provide a means to introduce and to withdraw material from the rotating calciner cylinder.

By contrast with directly heated rotary equipment, indirectly heated rotary calciners employ a different heat transfer mechanism. The major portion of the length of the rotating cylinder is enclosed in a stationary furnace and the outside of the cylinder, within the confines of the furnace, is heated with a stream of hot combustion products generated by burners (or a burner) which are normally mounted on the furnace wall. This heat is then conducted through the wall of the cylinder and is transferred to the bed of solid particles within the cylinder by a combination of radiation and conduction heat transfer processes.

In the case of indirectly heated rotary calciners and dryers, which are normally supported in two riding rings, the riding rings are located near the extreme ends of the cylinder to allow as much of the length of the cylinder as possible to be enclosed within the furnace.

This invention relates to indirectly heated rotary calciners and dryers rather than to directly heated rotary kilns and dryers.

The design of calciners is not well known. Limited design information is published in such textbooks as "The Handbook of Mineral Dressing" by Arthur F. Taggert (John Wiley & Sons, Inc., New York), which contains a section directed to the subject of rotary calciners and rotary dryers. Another test, "Perry's Handbook of Chemistry," also contains limited information on indirectly heated rotary calciners.

Traditionally, directly heated rotary equipment configurations such as rotary kilns and rotary dryers, as opposed to indirectly heated rotary calciners and dryers, are supported by riding rings located at any advantageous points along their exterior surface since no external furnace restricts their location. When two riding rings are employed as support points, each is normally located approximately 20% of the overall cylinder length from each end of the cylinder since this support arrangement equalizes, and minimizes, the various tensile and compressive forces within the cylinder.

It would be possible to provide cylinder extensions beyond the riding ring supports of an indirectly heated rotary calciner cylinder, each equal to approximately 33 to 50% of the heated length of the cylinder, to reduce the stress in the heated portion of the cylinder by nearly 50%, and this is one embodiment of this invention. But to do so would be expensive in terms of the equipment cost, and the equipment would occupy more space than shorter, weighted cylinder extensions, which act as moment arms, and are described in a preferred embodiment of the invention.

The preferred embodiment of this invention places weighted, artificial extensions on each end of the rotary indirectly heated calciner cylinder for the reduction of fiber stress in the heated portion of the cylinder, resulting in extended life of the heated portion of the calciner, and the potential to operate the calciner at higher temperatures.

It is, therefore, the intent of this invention to utilize the proposed cylinder extensions as moment arms which can be precisely calculated and then can be substituted by short extensions of the cylinder, each equipped with "dead" weights to precisely equal the required moment arm. It is recognized that the moment arm created by incidental items, such as a girt gear or a superficial extension of the cylinder section employed to preheat or to cool the calciner product, must be considered in the calculation of these moment arms.

The cylinder material may be any cast or fabricated alloy, the life of which will be greatly extended by these changes.

SUMMARY OF THE INVENTION

This invention relates to the particular type of calciner or dryer known in the art as an indirectly heated rotary calciner or dryer or other indirectly heated configuration which is operated at a relatively high temperature such as 600° to 2200° F. The calciner is heated by any fuel; typically oil or gas, and has a furnace surrounding its central section. This furnace provides heat to the cylinder within the confines of its length. Material to be heat-treated is fed into one end of the rotating cylinder and is extracted from the other end by means of stationary end enclosures known as breechings.

The invention, either for new installations or for retrofitted cylinders, employs either long cylindrical extensions beyond the riding ring supports or short extensions. The short extensions are weighted to provide the exact moment arm that will provide the minimum fiber stress in the heated portion of the cylinder.

DESCRIPTION OF THE PREFERRED EMBODIMENTS

Figure 3:
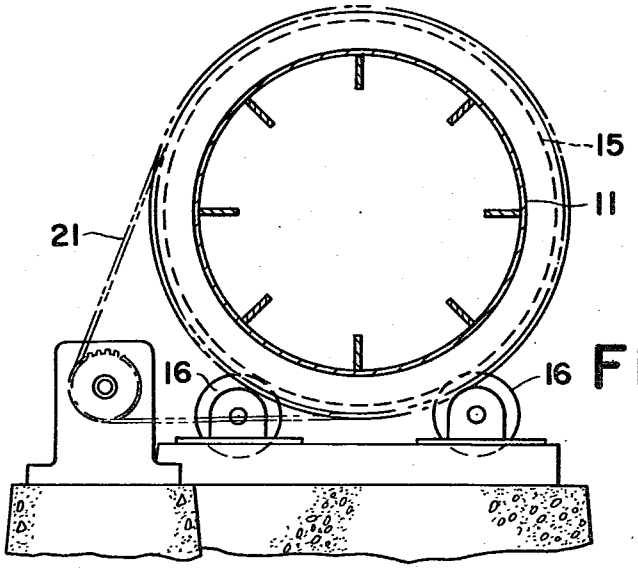
FIG. 3 is a cross section along line 3—3 of FIG. 1 showing means for rotating the cylinder consisting of a girt sprocket, motor, gear reducer and drive sprocket.
Figure 2:
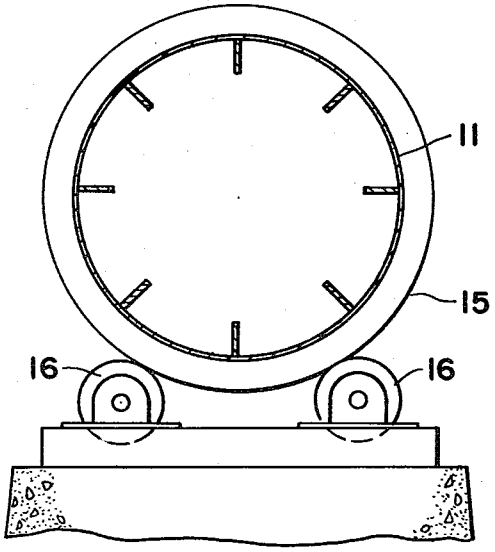
FIG. 2 is a cross section along line 2—2 of FIG. 1 showing the trunnion rolls and a riding ring.
Figure 1:
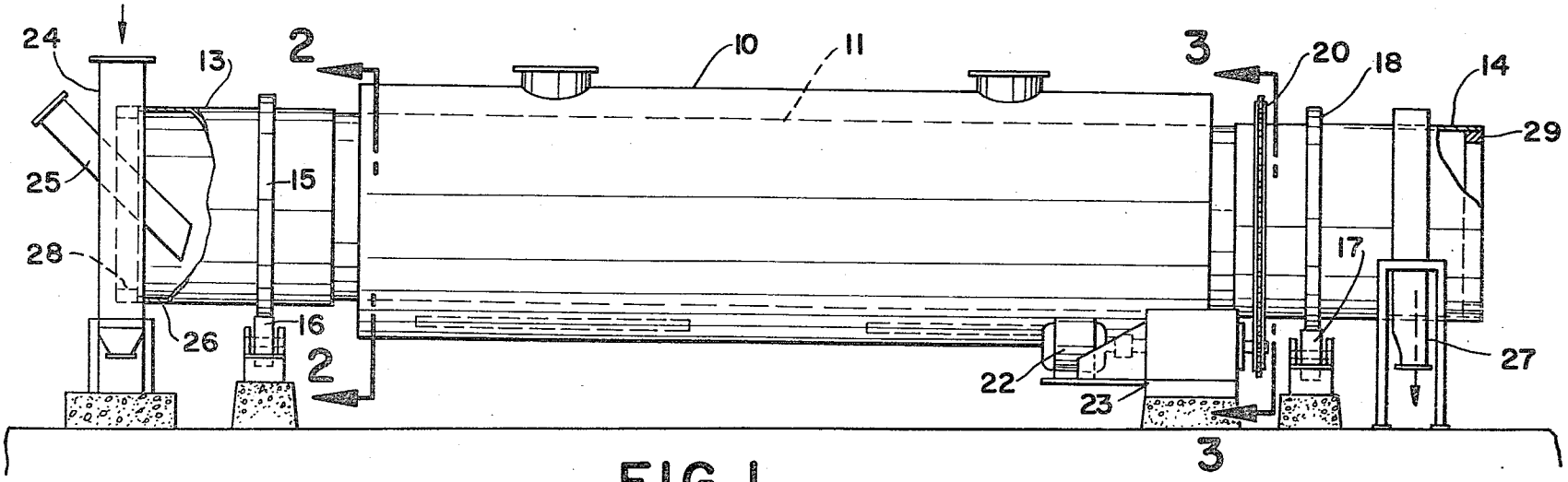
FIG. 1 is an elevation, partially cut away, of a simplified indirectly heated rotary calciner or dryer which embodies the preferred features of this invention.

FIG. 1 shows, in simplified form, the preferred embodiment of the indirectly heated calciner or dryer of this invention, wherein 10 shows the furnace casing, the inside of which is generally refractory lined. Heat is provided in the furnace by one or more burners normally mounted on the side wall of the furnace. The furnace heats the center portion of the cylinder 11 to a high temperature, perhaps in the range of 600° to 2200° F. In one particular example the cylinder temperature is approximately 1800° F.

Extending from each end of the center portion of cylinder 11 are cylindrical extension members indicated as 13 on the left and 14 on the right. These extension members may be of the same alloy as the center portion of the cylinder or they may be of some other, perhaps less expensive, alloy. They may be attached to the center portion of the cylinder by several methods such as direct weldment or by bolting companion flanges together.

Providing support for the cylinder on the left is a riding ring 15 and trunnion rolls 16. At the opposite end, note another pair of trunnion rolls 17 and riding ring 18. A girt sprocket 20 with chain drive 21 is driven by a motor 22 coupled to a gear reducer 23 to provide a means for rotating the cylinder.

Breechings are provided at, or near, the ends of the cylinder extensions to provide a means for the introduction and removal from the cylinder assembly of particulate matter to be heat treated. The feed breeching 24 is typically equipped with a feed chute 25 which deposits feed directly into the cylinder extension shown at 26. A discharge breeching 27 accepts heat treated material which, in this particular embodiment, falls into the discharge breeching through holes cut in the cylinder. The discharge breeching 27 could equally as well have been located at the extreme discharge end of the cylinder assembly except that in certain retrofit applications of the invention, it would be desirable to maintain feed and discharge points to correspond to those of the original equipment installation.

Note in particular cylinder extensions 13 and 14 which extend beyond riding rings 15 and 18 and which include at each end a "dead" weight which could be a carbon steel ring 28 on the left and 29 on the right. This "dead" weight could be provided by other means or other materials since its only function is to counterweight the center portion of the cylinder.

Shortened extensions 13 and 14 with their respective weighted rings 28 and 29 provide moment arms as though each of the extensions was actually one-third to one-half the length of the cylinder between the riding ring supports. Shortened extensions of a few feet in length with "dead" weights are provided to act as the equivalent moment arms of longer extensions. In this manner cylinder stress is reduced to an order of magnitude of approximately half that of any prior, similar installations.

This is desirable because in new installations, operating temperatures are constantly being increased. Even if the earlier alloys, used to construct the cylinders of indirectly heated calciners, are replaced with newer alloys having higher stress to rupture values and requiring higher stress to produce 1% creep properties, the cost of the installation would be increased and, too, it is important to design maximum life expectancy into new or replacement calciner cylinders.

To design maximum life in new and replacement calciner cylinders, stress is reduced by means of the weighted extensions so that when these newer alloys are used, it is possible to reduce the stress to a level that will yield long life in the alloy under high temperature operation.

By way of example, a relatively new alloy, such as Incolloy 800-H, has a stress to rupture of 1030 psi in 10,000 hours at 1800° F. This stress is reduced to 800 psi for a life of 100,000 hours. The stress required to produce 1% creep is 1010 psi for 10,000 hours but is only 580 psi for 100,000 hours at a temperature of 1800° F. In terms of this invention, then, if Incolloy 800-H is selected as the material of construction for a calciner to operate at 1800° F., and if it is desired to keep the fiber stress below 580 psi, which will produce only 1% creep in 100,000 hours, the weighted cylinder extensions permit this design, whereas the absence of weighted extensions does not. Thus, it is possible to substantially reduce and to control the fiber stress in the cylinder to prevent premature failure.

It will be appreciated that in retrofitting certain calciner cylinders with weighted cylinder extensions, the additional weight imposed upon the trunnion rolls, trunnion roll shafts and bearings could present mechanical problems. Should these problems occur, it is anticipated that they could be solved by flame hardening the trunnion rolls and by boring them for larger shafts which would be equipped with larger bearings.

Figure 4:
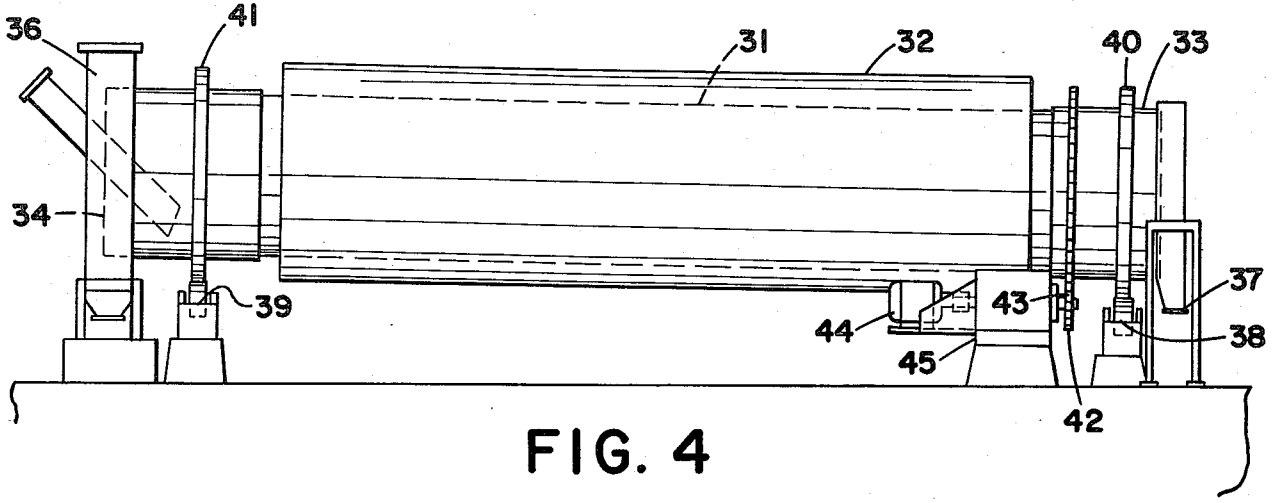
FIG. 4 is an elevational view of the prior art.

FIG. 4 is an elevation view of the prior art, where 31 shows the cylinder and 32 shows the furnace surrounding the heated portion of the cylinder. Short, unweighted extensions of the cylinder are shown at 33 on the right and 34 on the left. A feed breeching is shown at 36 and a discharge breeching at 37. Trunnion rolls are shown at 38 on the right and 39 on the left. The respective riding rings are shown at 40 and 41. The cylinder drive consists typically of a girt sprocket and chain at 42, a motor 44 and a gear reducer 45.

Note that the unweighted cylinder extensions 33 and 34 are of minimum length—long enough only to mount a riding ring on the left and a riding ring and the girt sprocket on the right. No attempt has been made to lengthen these extensions nor to weight them for the purpose of reducing the fiber stress in that portion of the cylinder enclosed by the furnace and thus subjected to elevated temperature.

In the present invention, then, when it is desirable to replace the prior art design, there is a need to increase temperature for a new installation, or for retrofitting, and to further reduce stress because of the inevitable increase in temperature. There would be much lower life expectancy unless the prior art could be redesigned to provide for lower fiber stresses in the cylinder.

Figure 5:
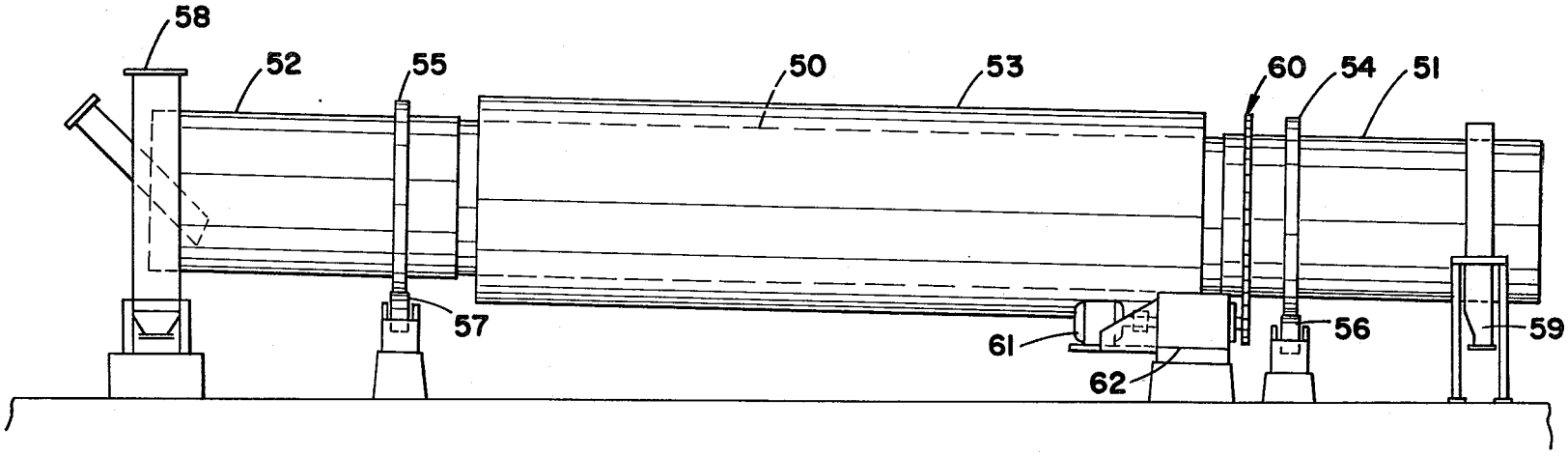
FIG. 5 is an alternative modification of FIG. 1 with long extensions beyond the riding rings.

FIG. 5 illustrates the basic concept of the instant invention, where the cylinder is shown at 50 with long extensions 51 on the right and 52 on the left. The furnace is shown at 53 with riding rings 54 and 55 and their respective trunnion rolls 56 and 57 with breeching means, particularly the feed device 58 and the discharge device 59 with drive sprocket or girt gear 60. The motor is shown at 61 and the reducing gear at 62. This version shows the extensions 51 and 52 of the cylinder which are from 20–25% of the over-all length of the cylinder for the purpose of producing minimum fiber stress in the center of the cylinder that is located halfway between riding rings 54 and 55 where fiber stress would normally be expected to be the greatest. In new installations where it is possible to set up feed and discharge points because of the availability of space, the longer extensions are feasible. In older installations, however, where feed and discharge points are fixed, shorter extensions with weights 28 and 29 are practically feasible in such retrofitting operations; for example, in large diameter calciner operations where a replacement calciner is required to operate at a new temperature range of 1800° F.

In FIG. 4, the fiber stress in connection with one installation was 520 psi. For simplicity of calculation, the short sections 33 and 34 in this view, i.e. the overhang past the riding rings, was disregarded. When calculations were done for the replacement cylinder with weighted rings 28 and 29, as shown in FIG. 1, the span between the riding rings was the same as in FIG. 4, but the weight of the extensions and their weighted sections 28 and 29 reduced the stress so that in a comparable calculation for the same dimensions with the design of FIG. 1, the stress was 260 psi. In other words, the maximum fiber stress was only half that calculated with respect to FIG. 4.

For a new installation with comparable operating conditions, FIG. 5 would be suitable, provided there was acceptance of the feed input at 58 and 59 as shown.

The invention has been described with reference to the preferred and alternate embodiments. Obviously, modifications and alterations will be readily apparent to others upon the reading and understanding of the specification. It is the intention to include all modifications and alterations insofar as they come within the scope of the appended claims or the equivalents thereof.

What is claimed is:

1. In an indirectly heated rotary calciner or dryer for high temperature operation in the range of 600° to 2200° F. comprising the following in combination:

A. a rotated cylinder with a heated center portion and extensions on each end;

B. a furnace surrounding said center portion;

C. two riding rings outwardly of the center portion of the cylinder;

D. trunnion rolls supporting said riding rings outwardly of the center portion of the cylinder;

E. means of driving said cylinder; and

F. breechings whereby granular particulate matter is introduced into and withdrawn from said cylinder.

2. The calciner or dryer of claim 1 in which the defined cylinder extensions have a weighted cylindrical mass near the ends of the cylinder to allow foreshortening of the cylinder extensions while still providing minimum fiber stress in the heated portion of the cylinder.

3. In an indirectly heated rotary calciner or dryer for high temperature operation in the range of 600° to 2200° F. comprising the following in combination:

A. a rotated cylinder with a heated center portion and extensions on each end;

B. a furnace surrounding said center portion;

C. two riding rings outwardly of the center portion of the cylinder;

D. trunnion rolls supporting said riding rings outwardly of the center portion of the cylinder;

E. means of driving said cylinder;

F. breechings whereby granular particulate matter is introduced into and withdrawn from said cylinder; and G. said cylinder and extensions thereof beyond the riding rings on each end of the cylinder are from 33 to 50% of the length of the cylinder between its riding ring supports.

4. The calciner or dryer of claim 3 in which the extensions are replaced with foreshortened and weighted extensons having an equivalent moment arm.

* * * * *